United States Patent [19]

Hansmann

[11] Patent Number: 4,870,741

[45] Date of Patent: Oct. 3, 1989

[54] WALL RACKING TOOL

[76] Inventor: Thomas A. Hansmann, 10594 Combie Rd. #6340, Auburn, Calif. 95603

[21] Appl. No.: 227,132

[22] Filed: Aug. 2, 1988

[51] Int. Cl.[4] ..... B23Q 1/00

[52] U.S. Cl. ..... 29/271

[58] Field of Search ..... 269/238, 904, 910, 240, 269/257; 414/10, 11; 294/106, 115; 29/271, 262

[56] References Cited

U.S. PATENT DOCUMENTS

| | | | |
|---|---|---|---|
| 460,883 | 10/1891 | Nugent | 269/238 |
| 2,280,422 | 4/1942 | Harcos . | |
| 3,357,464 | 12/1967 | Vroman . | |
| 3,370,213 | 2/1968 | Rose | 294/115 |
| 3,402,455 | 9/1968 | Converse . | |
| 3,712,482 | 1/1973 | Bondowski | 414/11 |
| 3,905,486 | 9/1975 | Genson | 414/10 |
| 4,262,410 | 4/1981 | Roberts | 294/106 |
| 4,281,868 | 8/1981 | Lovitt | 294/106 |
| 4,303,269 | 12/1981 | Faughnam | 294/106 |
| 4,416,104 | 11/1983 | Yamada . | |
| 4,500,078 | 2/1985 | Brennan | 269/238 |

FOREIGN PATENT DOCUMENTS

| | | | |
|---|---|---|---|
| 592742 | 2/1978 | U.S.S.R. | 414/10 |

*Primary Examiner*—Robert C. Watson
*Attorney, Agent, or Firm*—Jerry T. Kearns

[57] ABSTRACT

A wall racking tool for enabling a single individual to align and plumb walls in framing construction utilizes a clamp for securement to a sill plate of an erected frame wall. A first pulley attached to the clamp body is connected to a second pulley by a rope. A jam cleat on the second pulley secures the rope in tension. The second pulley is attached to a top rail of a second erected wall. The second wall is aligned and plumbed by tensioning the rope. The clamp has a pair of parallel right angle channel side rails connected by a cross bar. Opposite ends of the cross bar are connected to the side rails for pivotal and limited longitudinal sliding movement. An axially fixed threaded rod is received for rotation within a journal bore formed through the cross bar. A traverse plate has a threaded bore engaging the threaded rod. Two pairs of levers extend from a top surface of each of the side rails. Four pivotal links secure the levers to end faces of the traverse plate. Rotation of a handle on the threaded rod causes linear movement of the traverse plate, moving the side rails into clamping engagement with the sill plate of a frame wall. The pivotal links and levers provide inward and downward clamping force components to each of the side rails.

11 Claims, 5 Drawing Sheets

WALL RACKING TOOL

BACKGROUND OF THE INVENTION

1. Field of the Invention

The present invention relates to framing construction, and more particularly pertains to a wall racking tool for bringing erected and nailed frame walls into proper alignment and plumb. In conventional frame construction, walls are nailed together in a horizontal orientation on a floor deck surface and are then erected and nailed in a vertical orientation. After the walls are erected and nailed, they must be brought into proper alignment and plumb. At this point, braces attached to the erected walls are nailed for temporarily retaining the walls in the proper orientation. As conventionally performed, the task of aligning and plumbing walls requires from two to four individuals. The present invention provides a wall racking tool which enables a single individual to efficiently align and plumb frame walls.

2. Description of the Prior Art

Various types of clamping devices are known in the prior art. A typical example of such a clamping device is to be found in U.S. Pat. No. 2,280,422, which issued to A. Harcos on Apr. 21, 1942. This patent discloses a fishing tool for recovering objects from within oil and water wells. The device utilizes a rotatable threaded rod provided with a handle for radially extending and retracting pivoted clamping jaws. U.S. Pat. No. 3,357,464, which issued to W. Vroman on Dec. 12, 1967, discloses a carpenter's aligning tool for aligning framing members which utilizes a pivotal clamping jaw. U.S. Pat. No. 3,402,455, which issued to K. Converse on Sept. 24, 1968, discloses a wheel puller which utilizes a vertically extending threaded rod provided with a head portion for engagement with a wrench in conjunction with pivotal spring biased jaws for exerting an axial pulling force on a wheel. U.S. Pat. No. 4,416,104, which issued to T. Yaada on Nov. 22, 1983, discloses a clamping mechanism for an impulse sealer which includes a pair of drive arms pivotally mounted on a flat base and a pressure arm pivotal about the same pivot point between the drive arms.

While the above mentioned devices are suited for their intended usage, none of these devices provide a wall racking tool which enables a single individual to align and plumb frame walls. Additionally, none of the aforesaid devices disclose a clamping structure capable of providing inward and downward clamping force components on the sill plate of a frame wall. Inasmuch as the art is relatively crowded with respect to these various types of clamping devices, it can be appreciated that there is a continuing need for and interest in improvements to such devices and in this respect, the present invention addresses this need and interest.

SUMMARY OF THE INVENTION

In view of the foregoing disadvantages inherent in the known types of clamping devices now present in the prior art, the present invention provides an improved clamping structure for a wall racking tool. As such, the general purpose of the present invention, which will be described subsequently in greater detail, is to provide a new and improved wall racking tool which allows a single individual to align and plumb frame walls.

To attain this, a representative embodiment of the concepts of the present invention is illustrated in the drawings and makes use of a clamp for releasable securement to a sill plate of an erected and nailed frame wall. A first pulley is secured by a connection ring to the clamp body and is connected to a second pulley by a length of rope. A jam cleat on the second pulley secures the rope at a selected tension. The second pulley is attached to a top rail of a second erected wall by a short line. The second wall may be brought into correct alignment and plumbed by tensioning the rope to the correct extent. The device allows a single individual to align and plumb frame walls. This task as conventionally accomplished, requires at least two individuals. The clamp is formed by a pair of spaced parallel right angle channel side rails connected by an elongated transversely extending cross bar. Opposite bifurcated end yoke portions of the cross bar are connected to the side rails for pivotal and limited longitudinal sliding movement. A vertically extending threaded rod is axially fixed and mounted for rotation within a central vertical journal bore formed through the cross bar. A traverse plate has a central threaded bore in threaded engagement with the threaded rod. A handle is fixed to a top end of the threaded rod and allows the threaded rod to be rotated, causing the traverse plate to reciprocate along the threaded rod. Two pairs of levers extend vertically from a top surface of each of the side rails. Four pivotal links secure the levers to opposite end faces of the traverse plate. By selective rotation of the handle, the side rails may be brought into clamping engagement with the sill plate of a frame wall. The pivotal links and levers provide inward and downward clamping force components to each of the side rails.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved wall racking tool which has all the advantages of the prior art wall racking tools and none of the disadvantages.

It is another object of the present invention to provide a new and improved wall racking tool which may be easily and efficiently manufactured and marketed.

It is a further object of the present invention to provide a new and improved wall racking tool which is of a durable and reliable construction.

An even further object of the present invention is to provide a new and improved wall racking tool which is susceptible of a low cost of manufacture with regard to both materials and labor, and which accordingly is then susceptible of low prices of sale to the consuming public, thereby making such wall racking tools economically available to the buying public.

Still yet another object of the present invention is to provide a new and improved wall racking tool which provides in the apparatuses and methods of the prior art some of the advantages thereof, while simultaneously overcoming some of the disadvantages normally associated therewith.

Still another object of the present invention is to provide a new and improved wall racking tool which enables a single individual to align and plumb frame walls.

Yet another object of the present invention is to provide a new and improved wall racking tool which provides an improved clamping mechanism for engagement with a sill plate of a first erected frame wall in conjunction with a pulley mechanism for engagement with a top rail of a second erected wall.

Even still another object of the present invention is to provide a new and improved wall racking tool having a clamping mechanism which utilizes pivotal links in conjunction with levers to provide inward and downward clamping force components to parallel right angle channel side rails for engagement with a sill plate of an erected wall.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
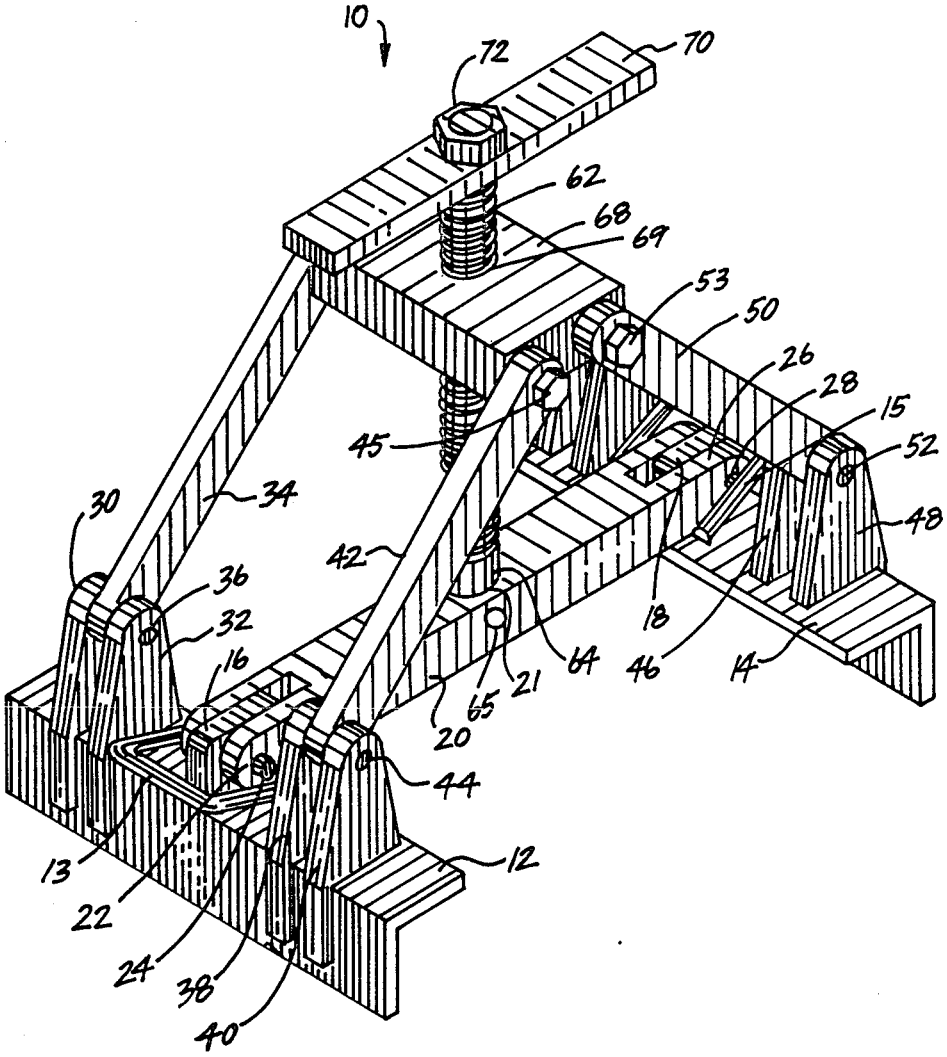
FIG. 1 is a perspective view of the clamping mechanism of the wall racking tool of the present invention.

With reference now to the drawings, and in particular to FIG. 1 thereof, a new and improved wall racking tool embodying the principles and concepts of the present invention and generally designated by the reference numeral 10 will be described.

More specifically, it will be noted that the first embodiment 10 of the invention includes a clamping mechanism having a pair of spaced parallel right angle channel side rails 12 and 14. A pair of attachment loops 13 and 15 are centrally secured on a top surface of each of the side rails 12 and 14. These attachment loops 13 and 15 allow alternative connection of a pulley mechanism, to be described subsequently, at either side of the clamping mechanism. A pair of vertically upstanding mounting tabs 16 and 18 are secured at a midpoint on a top surface of each of the side rails 12 and 14. Each of the mounting tabs 16 and 18 is provided with a horizontal slot. An elongated cross bar 20 has opposite bifurcated end yoke portions 22 and 26 in engagement with the mounting tabs 16 and 18, respectively. Pivot pins 24 and 28 extend through the yoke end portions 22 and 26 and through the slotted mounting tabs 16 and 18. Thus, the cross bar 20 is mounted for pivotal and limited longitudinal sliding movement between the side rails 12 and 14. A vertically extending journal bore 21 is formed centrally through the cross bar 20. An elongated threaded rod 62 extends vertically upwardly through the journal bore 21. The threaded rod 62 has a non-threaded bearing portion 64 which is received for rotation within the journal bore 21. A retaining pin 65, which may be in the form of a set screw, extends through a side wall of the cross bar 20 and into engagement with a circular groove formed around the circumference of the bearing portion 64 of the threaded rod 62. The retaining pin 65 allows the bearing portion 64 to rotate freely within the bore 21, but secures the threaded rod 62 against axial movement relative to the cross brace 20. A rectangular traverse plate 68 has a central threaded bore 69 in threaded engagement with the threaded rod 62. A handle 70 is fixedly secured to a top end of the threaded rod 62 by a pair of nuts, the upper one of which is illustrated at 72. Alternatively, the handle 70 may be secured by welding or by pin. A first pair of elongated pivotal links 42 and 50 each have a first end pivotally attached to a first end face of the traverse plate 68 by pivot mounting bolts 45 and 53. A second pair of elongated pivotal links, one of which is illustrated at 34, are similarly secured to a second opposite end face of the traverse plate 68. A first pair of slightly spaced apart, vertically upstanding levers 38, 40 and 46, 48 are secured adjacent a first end of each of the side rails 12 and 14. Each of the first pair of elongated pivotal links 42 and 50 have a second end pivotally mounted between one pair of the first pair of levers. The pivotal link 42 is pivotally mounted between the levers 38 and 40 by a pivot pin 44. The second end of the pivotal link 50 is pivotally mounted between levers 46 and 48 by pivot pin 52. A second pair of slightly spaced apart vertically upstanding levers, one pair of which is illustrated at 30 and 32, are secured adjacent a second end on each of the side rails 12 and 14. A second end of each of the second pair of elongated pivotal links, one of which is illustrated at 34, are pivotally mounted between one pair of the second pairs of levers. The second end of the pivotal link 34 is pivotally mounted between the levers 30 and 32 by a pivot pin 36.

Figure 2:
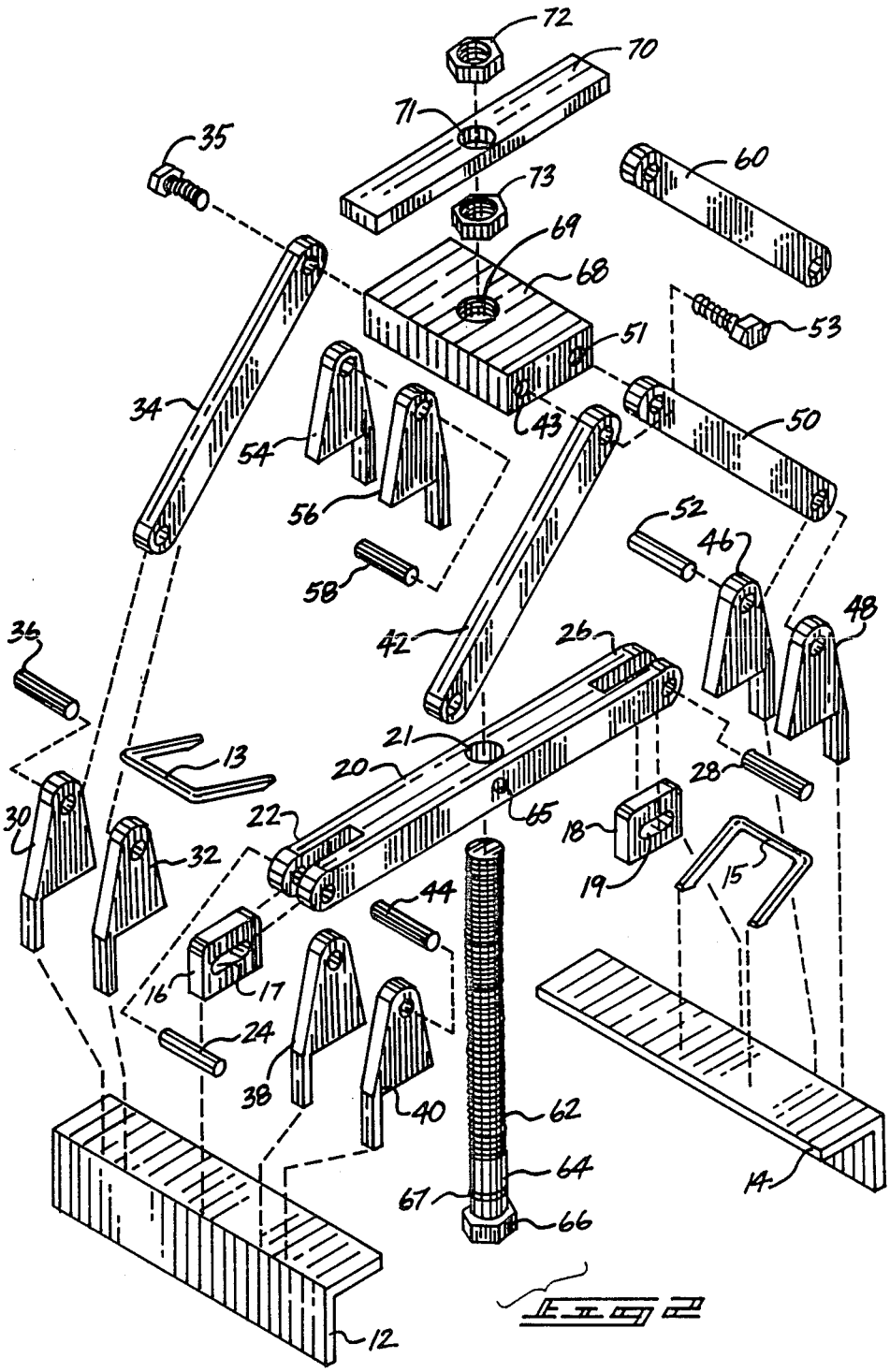
FIG. 2 is an exploded perspective view of the clamping mechanism.

As shown in FIG. 2, a second pair of levers 54 and 56 are mounted on the side rail 14 and serve to pivotally mount a second end of a pivotal link 60 on a pivot pin 58. The lower securing nut 73 of the handle 70 is illustrated in FIG. 2. The circumferential groove 67 on the non-threaded bearing portion 64 of the threaded rod 62 is formed adjacent an enlarged head portion 66. In an assembled condition, the enlarged head portions 66 is in abutment with a bottom surface of the cross bar 20. The retaining pin or set screw 65 is in engagement with the groove 67 and restrains the threaded rod 62 against axial movement relative to the cross bar 20, but allows free rotation of the bearing portion 64 within the journal bore 21. The mounting tabs 16 and 18 are provided with respective horizontal slots 17 and 19 for the reception of pivot pins 24 and 28 which, as previously described, mounts the yoke end portions 22 and 26 of the cross bar 20 for pivotal and limited longitudinal sliding movement. The first end of the pivotal link 34 is pivotally mounted to a second end face of the traverse plate 68 by a pivot bolt 35.

Figure 3:
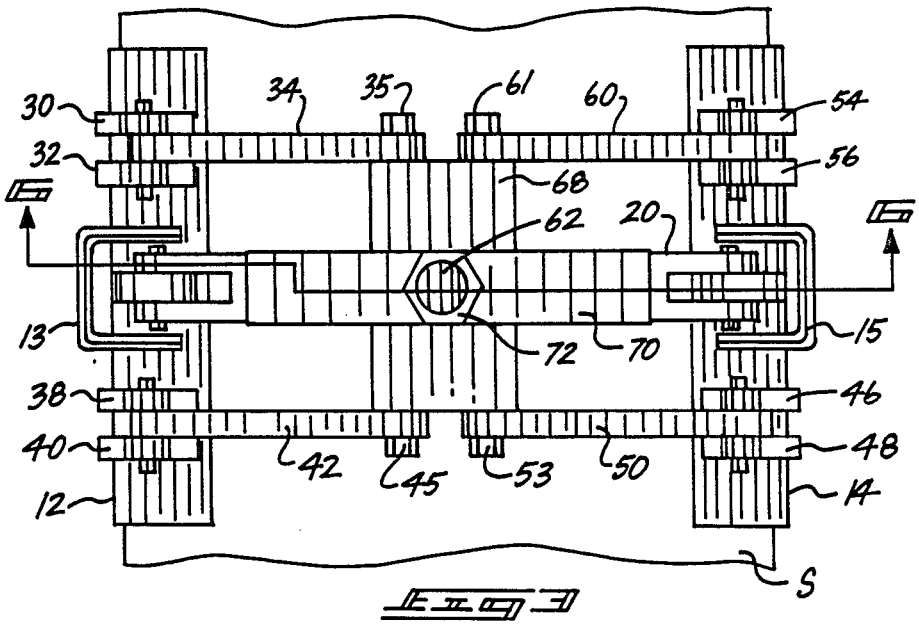
FIG. 3 is a top view of the clamping mechanism in engagement with the sill plate of a frame wall.

FIG. 3 provides a top view of the clamping mechanism in engagement with the sill plate S of a conventional frame wall. The second end of the pivotal link 60 is secured to the second end face of the traverse plate 68 by a pivot mounting bolt 61.

Figure 4:
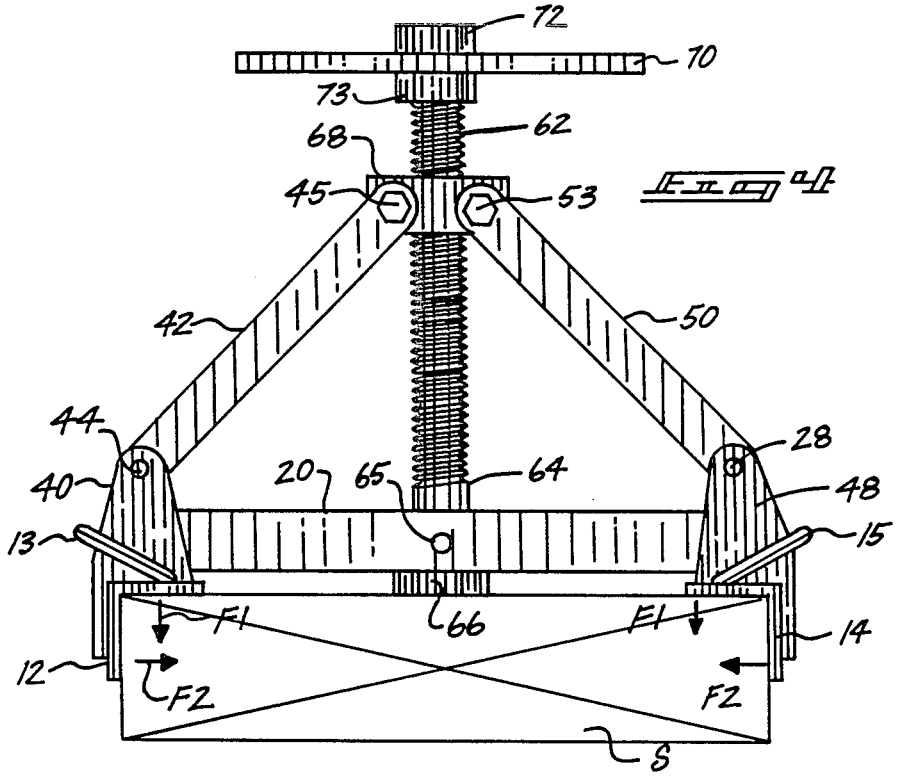
FIG. 4 is a end view of the clamping mechanism in engagement with the sill plate of a frame wall.

In FIG. 4, an end view illustrates the clamping mechanism in engagement with the sill plate S of a conventional frame wall unit. By rotation of the handle 70, the traverse plate 68 is caused to be fed axially along the threaded rod 62. As the traverse plate 68 is moved downwardly along the threaded rod 62, toward the cross brace 20, the levers on each of the side rails 12 and 14 are forced downwardly and outwardly. Here for example, the top ends of the levers 40 and 48 are forced downwardly and outwardly by forces transmitted from the pivotal links 42 and 50 to the pivot pins 44 and 28. This causes the attached side rails 12 and 14 to be forced downwardly and inwardly, into clamping engagement with the sill plate S. The downward clamping force component is illustrated by arrows F1 and the inward clamping force component is illustrated by arrows F2. The enlarged head portion 66 of the threaded rod 62 is spaced slightly above the upper surface of the sill plate S, and rotates freely relative thereto. When it is desired to disengage the clamping mechanism from the sill plate S, the handle 70 is rotated in an opposite direction, causing the traverse plate 68 to move upwardly along the threaded rod 62, causing the top ends of the levers to be moved upwardly and inwardly. This moves the right angle channel side rails 12 and 14 out of engagement with the sill plate S. The relative clamping movement of the side rails 12 and 14 is provided by the horizontal slotted portions 17 and 19 of the mounting tabs 16 and 18 (FIG. 2).

Figure 5:
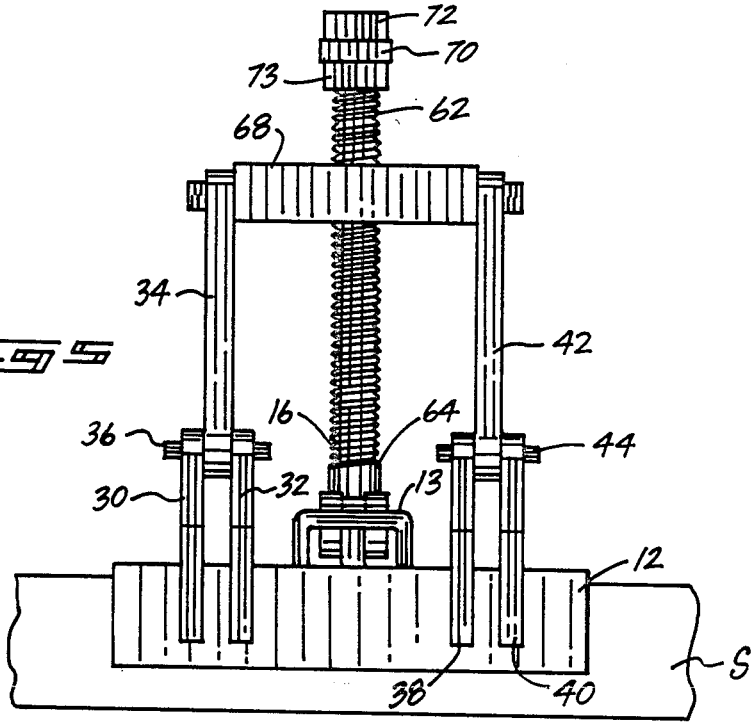
FIG. 5 is a side view of the clamping mechanism in engagement with the sill plate of a frame wall.

FIG. 5 provides a side view of the clamping mechanism in engagement with the sill plate S of a conventional frame wall.

Figure 6:
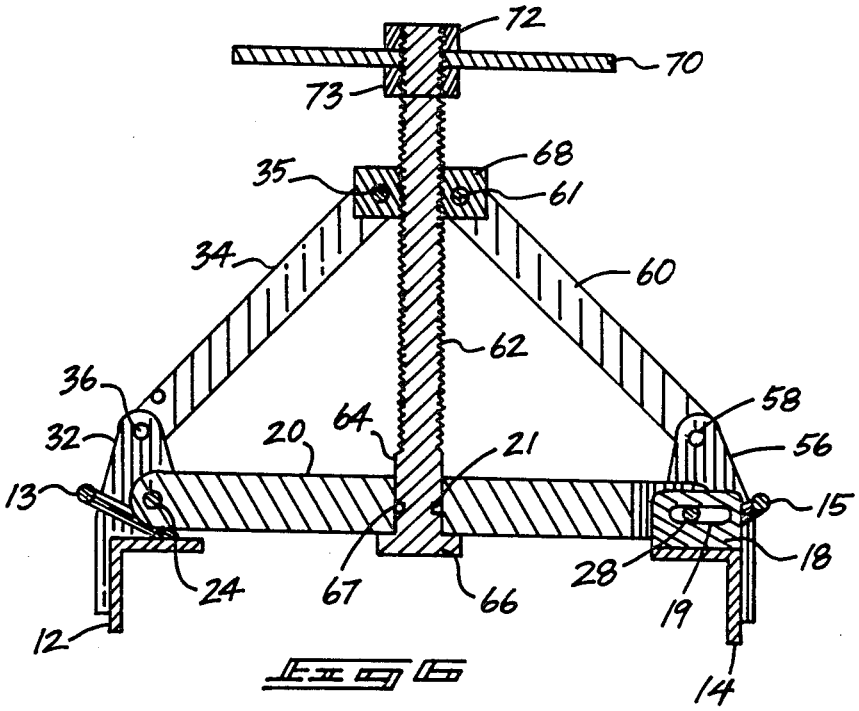
FIG. 6 is a cross sectional view, taken along line 6—6 of FIG. 3, further illustrating the construction of the clamping mechanism.

FIG. 6 provides a transverse cross sectional view, taken along line 6—6 of FIG. 3, which further illustrates the construction of the clamping mechanism.

Figure 7:
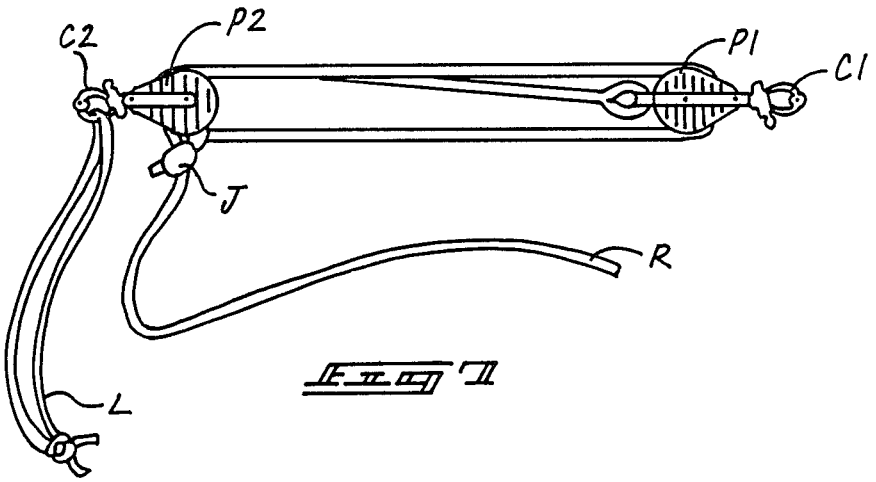
FIG. 7 illustrates the pulley mechanism of the wall racking tool of the present invention.

FIG. 7 illustrates a pulley arrangement which is utilized in conjunction with the clamping mechanism to form the wall racking tool of the present invention. A first pulley Pl has a quick release type connection ring Cl for engagement with one of the attachment loops 13 or 15 of the clamping mechanism. The first pulley Pl is connected by a rope R to a second pulley P2. A jam cleat J is provided on the second pulley P2 for retaining the rope R at a selected tension. The pulley P2 and jam cleat J are of conventional construction and are of the type normally utilized for securing the sails of sail boats in desired condition. The second pulley P2 has a second quick release type connection C2 for engagement with a line L for securing the second pulley P2 to the top rail of a frame wall.

Figure 8:
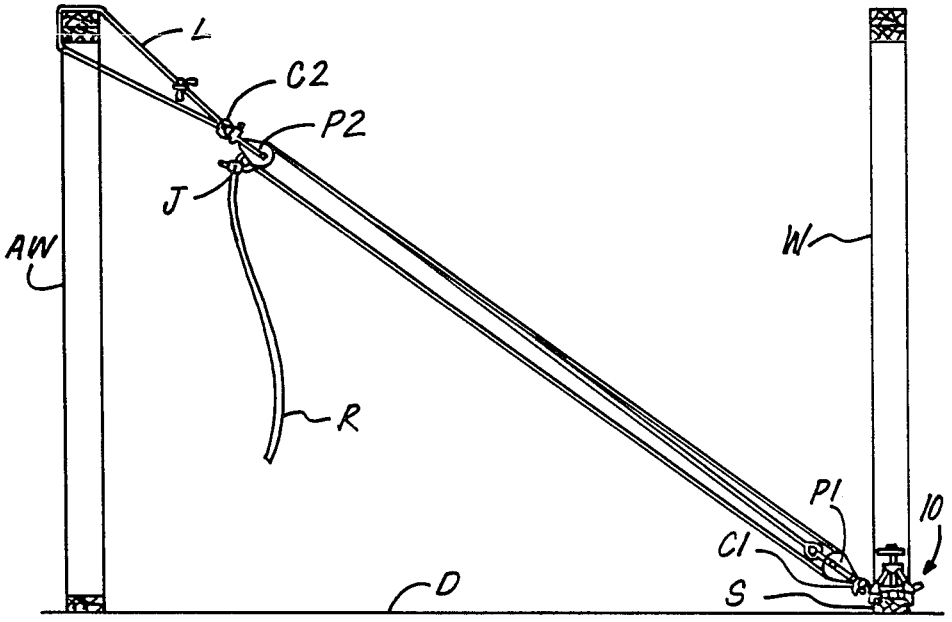
FIG. 8 provides a diagrammatic illustration of the manner of usage of the wall racking tool of the present invention.

In FIG. 8, a diagrammatic illustration is provided which illustrates the manner of usage of the wall racking tool 10 of the present invention. A pair of frame wall W and AW are constructed, erected and nailed in a conventional fashion on the floor deck D of a house or other building under construction. The clamping mechanism is then engaged with the sill plate S of one of the walls W. The connection Cl of the pulley P1 is then connected to one of the attaching loops 13 or 15. The line L on the connection ring C2 is tied around the top rail of a second opposed wall AW. The free end of the rope R is then pulled tight, causing a tension in the rope between the pulleys Pl and P2. A conventional level or other measuring instrument is utilized to determine the correct alignment and plumb of the wall AW and the tension of the rope R is adjusted until the wall AW is in proper alignment. The temporary bracing is then nailed in place in a conventional fashion. As may now be readily understood, the wall racking tool of the present invention allows a single individual to erect, align and plumb frame wall units. The jam cleat J serves to retain the rope R at an adjusted tension, thus freeing the hands of the individual for measuring alignment of the wall and nailing the bracing.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claimed:

1. A wall racking tool for aligning walls and framing construction comprising;

a pair of spaced parallel right angle channel side rails;

a vertically upstanding mounting tab secured at a midpoint on a top surface of each of said side rails, each of said mounting tabs having a horizontal slot;

an elongated cross bar having opposite bifurcated end yoke portions, each of said end yoke portions provided with a transverse bore;

said cross bar extending transversely between said side rails, said yoke end portions engaged in said mounting tabs and a pivot pin extending through each of said transverse bores in said yoke portions and through said mounting tab slots;

a vertically extending journal bore formed through said cross bar;

an elongated threaded rod extending vertically upwardly through said journal bore, said rod having an enlarged head portion in abutment with a bottom surface of said cross bar and a non threaded portion of said rod adjacent said head portion received for rotation within said journal bore and secured against axial movement;

a generally rectangular traverse plate having a central threaded bore in threaded engagement with said threaded rod;

a handle fixedly secured to a top end of said threaded rod, above said traverse plate, for rotating said threaded rod;

a first pair of elongated pivotal links, each having a first end pivotally attached to a first end face of said traverse plate;

a second pair of elongated pivotal links, each having a first end pivotally attached to a second end face of said traverse plate, opposite said first end face;

a first pair of slightly spaced apart vertically upstanding levers secured adjacent a first end of each of said side rails;

each of said first pair of elongated pivotal links having a second end pivotally mounted between one pair of said first pairs of levers;

a second pair of slightly spaced apart vertically upstanding levers secured adjacent a second end of said side rails;

each of said second pair of elongated pivotal links having a second end pivotally mounted between one pair of said second pairs of levers;

an attachment loop centrally attached on a top surface of each of said side rails;

a first pulley having a connector ring secured to one of said attachment loops;

a second pulley having a jam cleat;

a rope around said first and second pulleys and engaged by said jam cleat; and a line attached to said second pulley for securement to a framed wall.

2. A wall racking tool for aligning walls in framing construction, comprising;

a pair of spaced parallel right angle channel side rails;

an elongated cross bar extending transversely between said side rails;

opposite ends of said cross bar mounted from pivotal and limited longitudinal sliding movement on said side rails;

a vertically extending journal bore formed through said cross bar;

an elongated vertically extending threaded rod mounted for rotation and axially fixed within said journal bore;

a traverse plate having a central threaded bore in threaded engagement with said threaded rod;

a handle fixed to a top end of said threaded rod, for rotating and threaded rod;

at least one pair of pivotal links, each having a first end pivotally connected to said traverse plate and a second end pivotally connected to one of said side rails;

opposite bifurcated end yoke portions on said cross bar;

a transverse bore extending through each of said yoke portions;

a vertically upstanding mounting tab secured at a midpoint on a top surface of each of said side rails;

a horizontal slot in each of said mounting tabs;

said yoke end portions engaging said mounting tabs; and a pivot pin extending through each of said transverse bores in said yoke portions and through each of said mounting tab slots.

3. The wall racking tool of claim 2, further comprising vertically upstanding lever means secured on a top surface of each of said side rails, said second ends of said pivotal links pivotally connected to said lever means.

4. The wall racking tool of claim 2, further comprising attachment loop means centrally secured on a top surface of each of said side rails.

5. The wall racking tool of claim 4, further comprising:

a first pulley having a connector ring secured to one of said attachment means;

a second pulley having a jam cleat;

a rope around said first and second pulleys and engaged by said jam cleat; and a line attached to said second pulley for securement to a framed wall.

6. The wall racking tool of claim 2, wherein two pivotal links extend between said traverse plate and each of said side rails.

7. The wall racking tool of claim 6, wherein said traverse plate is generally rectangular and has first and second opposite end faces;

a first pivotal link having a first end pivotally mounted on said first end face and a second end pivotally mounted on said first side rail;

a second pivotal link having a first end pivotally mounted on said first end face and a second end pivotally mounted on said second side rail;

a third pivotal link having a first end pivotally mounted on said second end face and a second end pivotally mounted on said first side rail; and a fourth pivotal link having a first end pivotally mounted on said second end face and a second end pivotally mounted on said second side rail.

8. A wall racking tool for aligning walls in framing construction, comprising:

a pair of spaced parallel right angle channel side rails;

an elongated cross bar extending transversely between said side rails;

opposite ends of said cross bar mounted for pivotal and limited longitudinal sliding movement on said side rails;

a vertically extending journal bore formed through said cross bar;

an elongated vertically extending threaded rod mounted for rotation and axially fixed within said journal bore;

a traverse plate having a central threaded bore in threaded engagement with said threaded rod;

a handle fixed to a top end of said threaded rod, for rotating said threaded rod;

at least one pair of pivotal links, each having a first end pivotally connected to said traverse plate and a second end pivotally connected to one of said side rails;

attachment loop means centrally secured on a top surface of each of said side rails;

a first pulley having a connector ring secured to one of said attachment loop means;

a second pulley having a jam cleat;

a rope around said first and second pulleys and engaged by said jam cleat; and a line attached to said second pulley for securement to a framed wall.

9. The wall racking tool of claim 8, further comprising vertically upstanding lever means secured on a top surface of each of said side rails, said second ends of said pivotal links pivotally connected to said lever means.

10. The wall racking tool of claim 8, wherein two pivotal links extend between said traverse plate and each of said side rails.

11. The wall racking tool of claim 10, wherein said traverse plate is generally rectangular and has first and second opposite end faces;

a first pivotal link having a first end pivotally mounted on said first end face and a second end pivotally mounted on said first side rails;

a second pivotal link having a first end pivotally mounted on said first end face and a second end pivotally mounted on said second side rail;

a third pivotal link having a first end pivotally mounted on said second end face and a second end pivotally mounted on said first side rail; and a fourth pivotal link having a first end pivotally mounted on said second end face and a second end pivotally mounted on said second side rail.

* * * * *